US005089371A

United States Patent [19]

Nakamura et al.

[11] Patent Number: 5,089,371

[45] Date of Patent: Feb. 18, 1992

[54] HEAT DEVELOPMENT TYPE DIAZO COPYING MATERIAL CONTAINING A LIGHT INSENSITIVE INTERMEDIATE LAYER PROVIDED BETWEEN THE SUPPORT AND THE PHOTOSENSITIVE LAYER

[75] Inventors: Kotaro Nakamura; Toshiharu Tanaka; Hirokazu Shimada, all of Shizuoka, Japan

[73] Assignee: Fuji Photo Film Co., Ltd., Kanagawa, Japan

[21] Appl. No.: 382,369

[22] Filed: Jul. 20, 1989

[30] Foreign Application Priority Data

Jul. 21, 1988 [JP] Japan ..... 63-182678

[51] Int. Cl.[5] ..... G03C 1/91; G03C 1/775; G03C 1/54; G03C 1/56

[52] U.S. Cl. ..... 430/160; 430/138; 430/151; 503/215

[58] Field of Search ..... 430/138, 151, 171, 176, 430/160, 155; 503/215

[56] References Cited

U.S. PATENT DOCUMENTS

| | | | |
|---|---|---|---|
| 3,111,407 | 2/1960 | Lindquist et al. | 430/138 |
| 3,202,510 | 8/1965 | Hollmann | 430/151 |
| 4,644,376 | 2/1987 | Isomi et al. | 503/215 |
| 4,705,736 | 11/1987 | Notley | 430/160 |
| 4,758,495 | 7/1988 | Yamaguchi et al. | 430/138 |
| 4,760,048 | 7/1988 | Kurihara et al. | 430/151 |
| 4,891,297 | 1/1990 | Takashima et al. | 430/138 |

FOREIGN PATENT DOCUMENTS

| | | |
|---|---|---|
| 0123224 | 10/1984 | European Pat. Off. . |
| 0184132 | 6/1986 | European Pat. Off. . |
| 1805357 | 5/1970 | Fed. Rep. of Germany . |

OTHER PUBLICATIONS

Communication with European Search Report dated Jun. 5, 1990.

6001, Chemical Abstracts, vol. 76 (1972) No. 24, Jul. 1972 (147266), p. 476.

Journal of Imaging Technology, vol. 11, No. 3, Jun. 1985, Springfield, VA., USA, pp. 137-142, Hirotsugu Sato et al.: "UV-Fixable Thermal Recording Paper".

*Primary Examiner*—Charles L. Bowers, Jr.
*Assistant Examiner*—John S. Chu
*Attorney, Agent, or Firm*—Sughrue, Mion, Zinn, Macpeak & Seas

[57] ABSTRACT

The present invention is directed toward a heat development copying material, comprising a support having provided thereon a photosensitive layer containing a diazo compound, a coupling component, a color-forming assistant, and a film-forming high polymeric binder; and a light-insensitive intermediate laeyr containing a film-forming high polymeric binder, and at least one member selected from the group consisting of a coupling component and a color-forming assistant, wherein the light-insensitive intermediate layer is provided between the support and the photosensitive layer, and a method for forming an image using the above-described copying material.

3 Claims, No Drawings

HEAT DEVELOPMENT TYPE DIAZO COPYING MATERIAL CONTAINING A LIGHT INSENSITIVE INTERMEDIATE LAYER PROVIDED BETWEEN THE SUPPORT AND THE PHOTOSENSITIVE LAYER

FIELD OF THE INVENTION

This invention relates to a heat development type copying material utilizing a photosensitive diazo compound (diazonium salt), and more particularly to a heat development type copying material which provides high quality copies exhibiting uniform density.

BACKGROUND OF THE INVENTION

Known copying materials utilizing photosensitive diazo compounds are divided into three types. The first one is known as a wet development type, which comprises a support having provided thereon a photosensitive layer comprising a diazo compound and a coupling component. This material in intimate contact with an original, is exposed to light and developed with an alkaline solution. The second one is known as a dry development type, which is different from the wet development type in that ammonia gas is used in place of the alkaline solution. The third one is known as a heat development type and includes a type of material in which a photosensitive layer contains an ammonia gas-generating agent capable of generating ammonia gas upon heating, such as urea; a type in which a photosensitive layer contains an alkali salt of an acid which loses acidic properties upon heating, such as trichloroacetic acid; and a type in which a photosensitive layer contains a higher molecular weight fatty acid amide as a color forming assistant which activates a color forming reaction between a diazo compound and a coupling component upon heat-melting.

Disadvantages associated with the use of a wet development type copying material include the necessity of replenishment or disposal of the developing solution, maintenance of a large-sized apparatus and inability to write on the copies immediately after removal from equipment because of wetness. In addition, the reproduced image is not stable, i.e., does not withstand long-term storage.

The dry development type copying material also involves the use of developing solution and thus, the disadvantages include those associated with the use of a wet development type. In addition, other disadvantages include the requirement of large-sized gas absorption equipment for preventing leaks of ammonia gas, and the copies immediately after removal from the equipment smell of ammonia.

On the other hand, the heat development type copying material is advantageous in that equipment maintenance is minimum because no developing solution is used. Nevertheless, any of the state-of-the-art heat development type copying materials require high temperatures ranging from 150° to 200° C. for development. Moreover, the developing temperature must be controlled within 10° C. of the prescribed temperature. Otherwise, the development becomes insufficient or the tone of the reproduced image is changed. Therefore, the apparatus cost is high. In addition, the diazo compound must be highly heat resistant for use in high temperature development, and such heat-resistant diazo compounds are disadvantageous in that high density images are not obtained. Attempts to develop such materials at low temperatures (90° to 130° C.) have resulted in copying materials having a reduced shelf life.

Thus, in spite of the fact that heat development type copying materials are advantageous as to equipment maintenance over the wet or dry development types, they still have significant disadvantages and thus are not routinely used.

In the heat development type copying materials comprising a support having provided thereon a photosensitive layer containing a diazo compound, a coupling component, and a color forming assistant, each of the components must be melted, diffused and reacted with heat to form a dye before a desired color density can be obtained. Assuming that a copying material which would undergo a color formation reaction at a low heating temperature to obtain a high density image could be successfully designed the problem of the color formation reaction taking place while the material before copying is held at room temperature may still be encountered. Should the reaction occur, the background of the copying material, which should be white, becomes colored.

The inventors conducted extensive studies in order to solve the above-described conflicting problems. As a result, they found that encapsulization of at least one, of the diazo compound and the coupling component, is a basic solution.

The developed color density of heat development type copying materials is determined by the quantity of heat energy given and the amounts of color-forming components. High efficiency of heat conduction from a heating means to the copying material and uniformity of dye formation through the heat conduction are essential factors for obtaining a high quality copied image particularly as the developing temperature is lowered. In other words, if heat conduction is non-uniform due to the unevenness of a copying material, the dye formation is uneven, and unevenness of the image density may result. Further, if the color-forming components are localized due to the unevenness of a support, the dye formation similarly becomes uneven, resulting in unevenness of image density. It is therefore highly desirable to avoid such image density unevenness.

The microcapsules previously proposed for the purpose of satisfying both shelf life and heat sensitivity of heat development type copying materials are susceptible to the unevenness of the support surface because they exist as fine particles in a film. When using paper as a support, the microcapsules may penetrate into the support to cause non-uniform dye formation. Therefore, problems including uneven density of the copied image remain unsolved even with the copying materials using the microcapsules.

SUMMARY OF THE INVENTION

One object of this invention is to provide a copying material which can be developed at low temperatures to provide a high density.

Another object of this invention is to provide a copying material which is free from background coloring (fog) during storage before use, that is, having a satisfactory shelf life.

Still another object of this invention is to provide a copying material providing a high quality reproduced image, and exhibiting uniform density.

A further object of this invention is to provide an image formation method utilizing the above-described copying material, which is convenient to carry out and easy to control, combining a latent image formation process and a heat development process.

It has now been found that the above objects of this invention can be accomplished by a heat development type copying material comprising a support having provided thereon a photosensitive layer containing a diazo compound, a coupling component, a color forming assistant, and a film-forming high polymeric binder, wherein a light-insensitive intermediate layer containing a film-forming high polymeric binder, and at least one of a coupling component and a color forming assistant is provided between the support and the photosensitive layer.

It is preferable that at least one of the diazo compound and the coupling component, preferably the diazo compound, is encapsulated in microcapsules, the wall of the microcapsules being formed from at least one high molecular weight polymer selected from the group consisting of polyurea and polyurethane.

DETAILED DESCRIPTION OF THE INVENTION

Film-formimg high polymeric binders which can be used in the photosensitive layer and the intermediate layer includes one or more of water-soluble high molecular weight polymers and water-insoluble high molecular weight polymers.

The water-soluble high molecular weight polymers include methyl cellulose, carboxymethyl cellulose, hydroxyethyl cellulose, starches, gelatin, gum arabic, casein, styrene-maleic anhydride copolymer hydrolysis products, ethylene-maleic anhydride copolymer hydrolysis products, isobutylene-maleic anhydride copolymer hydrolysis products, vinyl acetate-maleic anhydride copolymer hydrolysis products, vinyl methyl ether-maleic anhydride copolymer hydrolysis products, polyvinyl alcohol, carboxy-modified polyvinyl alcohol silicon-modified polyvinyl alcohol, polyacrylamide, polyvinylpyrrolidone, and sodium alginate.

The water-insoluble high molecular weight polymers generally include synthetic rubber latices and synthetic resin emulsions. Examples thereof are a styrene-butadiene rubber latex, and acrylonitile-butadiene rubber latex, a methyl acrylate-butadiene rubber latex, a polyvinyl acetate emulsion, a polyacrylic emulsion, a polyester emulsion, and a polyurethane emulsion.

It is preferable that at least one of the film-forming high polymeric binders used in the present invention is polyvinyl alcohol.

The coupling component to be used in the photosensitive and intermediate layers is a compound capable of coupling with a diazo compound in a basic atmosphere to form a dye, including active methylene compounds having a methylene group in the immediate neighborhood of a carbonyl group, phenol derivatives, and naphthol derivatives.

Specific examples of the coupling components are resorcin, ploroglucin, sodium 2,3-dihydroxynaphthalene-6-sulfonate, 1-hydroxy-2-naphthoic acid morpholino-propylamide, 1,5-dihydroxynaphthalene, 2,3-dihydroxynaphtalene, 2,3-dihydroxy-6-sulfanylnaphthalene, 2-hydroxy-3-naphthoic acid morpholino-propylamide, 2-hydroxy-3-naphthoic acid octylamide, 2-hydroxy-3-naphthoic acid anilide, benzoylacetanilide, 1-phenyl-3-methyl-5-pyrazolone, 1-(2,4,6-trichlorophenyl)-3-anilino-5-pyrazolone, 2-]3-α-(2,5-di-t-amylphenoxy)-butanamidobenzamido]phenol, 2,4-bis(benzoylacetamino)-toluene, and 1,3-bis(-pivaloylacetaminomethyl)benzene.

These coupling components may be used either individually or in combinations of two or more. Any arbitrary hue can be obtained by appropriate selection of the coupling components.

The color forming assistant for use in the photosensitive and intermediate layers is preferably a basic substance which is capable of rendering the system basic at the time of heat development to accelerate a coupling reaction. The basic substance includes sparingly water-soluble or water-insoluble basic substances and substances capable of forming an alkali on heating.

Examples of the basic substances are nitrogen-containing compounds such as organic or inorganic ammonium salts, organic amines, amides, ureas or thioureas and derivatives thereof, thiazoles, pyrroles, pyrimidines, piperazines, guanidines, indoles, imidazoles, imidazolines, triazoles, morpholines, piperidines, amidines, formamidines, and pyridines. These basic substances may be used either individually or in combinations of two or more.

Further embraced in the color forming assistants to be used in the present invention are phenol derivatives, naphthol derivatives, alkoxy-substituted benzenes, alkoxy-substituted naphthalenes, alcohols, amide compounds, and sulfonamide compounds, which are added for the purpose of facilitating rapid and complete heat development at a low energy. These compounds are considered capable of reducing the melting point of the coupling component or the basic substance or increasing heat transmission through the capsule wall to thereby provide a high color density.

The color forming assistant may further include heat-fusible substances, preferably having a melting point between 50° C. and 150° C., which are solid at normal temperatures but melt on heating to fuse the diazo compound, the coupling component or the basic substance. Specific examples of such heat-fusible substances are fatty acid amides, N-substituted fatty acid amides, ketone compounds, urea compounds, and esters.

These color forming assistants may be used either individually or in combinations of two or more.

The diazo compound for use in the photosensitive layer is a photo-decomposable compound which is decomposed on exposure to light of specific wavelengths (wavelengths which can be absorbed by the diazo compound) prior to a color formation reaction and is then brought into contact with the coupling component and reacted therewith to develop a color upon heating.

The photo-decomposable diazo compounds generally include aromatic diazo compounds and, more specifically aromatic diazonium salts, diazosulfonate compounds, and diazoamino compounds. Photodecomposition wavelengths of the diazo compounds are generally considered to be the maximum absorption wavelengths thereof. It is also known that the maximum absorption wavelengths of the diazo compounds change from about 200 nm to about 700 nm according to the chemical structure thereof as described, e.g., in Takahiro Tsunoda and Tsuguo Yamaoka, *Nippon Shashin Gakkaishi*, Vol, 29, No. 4, pp. 197 to 205 (1965). This is, the diazo compound used as a photo-decomposable compound decomposes on exposure to light of a specific wavelength determined according to the chemical structure thereof. The hue of the dye formed by the coupling reaction can be varied by changing the chemical structure of the diazo compound, even when the coupling component remains unchanged.

The diazo compound can be represented by formula $ArN_2X$, wherein Ar represents a substituted or unsubstituted aromatic ring; $N_2$ represents a diazonium group; and X represents an acid anion.

In the present invention, a multi-color heat development type copying material can be provided by using diazo compounds differing in photo-decomposition wavelength or photo-decomposition rate.

Specific examples of suitable diazo compounds include 4-diazo-1-dimethylaminobenzene, 4-diazo-2-butoxy-5-chloro-1-dimethylaminobenzene, 4-diazo-1-methy-benzylaminobenzene, 4-diazo-1-ethylhydroxyethylamino-benzene, 4-diazo-1-diethylamino-3-methoxybenzene, 4-diazo-1-morpholinobenzene, 4-diazo-1-morpholino-2,5-dibutoxybenzene, 4-diazo-1-toluylmercapto-2,5-diethoxy-benzene, 4-diazo-1-piperazino-2-methoxy-5-chlorobenzene, 4-diazo-1-(N,N-dioctylaminocarbonyl)benzene, 4-diazo-1-(4-t-octylphenoxy)benzene, 4-diazo-1-(2-ethylhexanoylpiperidino)-2,5-dibutoxybenene, 4-diazo-1-(2,5-di-t-amylphenoxy-α-butanoylpiperidino)benzene, 4-diazo-1-(4-methoxy)-phenylthio-2,5-diethoxybenzene, 4-diazo-1-(4-methoxy)benzamido-2,5-diethoxybenzene, and 4-diazo-1-pyrrolidino-2-methoxybenzene.

Acids forming a diazonium salt with the above-recited diazo compounds include compounds of formula $C_nF_{2n+1}COOH$, wherein n is an integer of from 1 to 9; compounds of formula $C_mF_{2m+1}SO_3H$, wherein m is an integer of from 1 to 9; boron tetrafluoride, tetraphenylboron, hexafluorophosphoric acid, aromatic caroxylic acids, aromatic sulfonic acids, and metal halides (e.g., zinc chloride, cadmium chloride, and tin chloride).

The photosensitive layer and the intermediate layer can contain various pigments. Suitable inorganic and organic pigments include kaolin, calcined kaolin, talc, calcium carbonate, amorphous silica, barium sulfate, aluminum hydroxide, titanium oxide, agalmatolite, a urea-formalin resin fine powder, a polyethylene resin fine powder, and a polystyrene fine powder. In particular, the intermediate layer preferably contains a pigment having an oil absorption of 40 cc/100 g or more as determined according to JIS K-5101, and more preferably having a whiteness degree of 85% or more.

If desired, the photosensitive layer and the intermediate layer may further contain waxes, e.g., polyethylene wax, carnauba wax, paraffin wax, micro-crystalline wax, and fatty acid amides; metallic soaps, e.g., zinc stearate and calcium stearate; and surface active agents.

Microcapsules containing the diazo compound or the coupling component can be prepared according to known processes, e.g., the process disclosed in JP-A-59-190886 (the term "JP-A" as used herein means an "unexamined published Japanese patent application"). Further, it is desirable to use substantially solvent-free microcapsules which are prepared by dissolving the diazo compound or coupling component in a low-boiling non-aqueous solvent together with wall-forming monomers and effecting the polymerization reaction while removing the solvent by distillation. The polyurea or polyurethane forming the capsule wall can be prepared by polymerizing the corresponding monomers by the above-described polymerization process. The amounts of the monomers are determined so that the resulting microcapsules have an average particle size of from 0.3 to 12 μm and a wall thickness of from 0.01 to 0.3 μm.

In the photosensitive layer, it is preferable to use each of the coupling component and the basic substance in an amount of from 0.1 to 30 parts by weight per part by weight of the diazo compound. The diazo compound is preferably coated in an amount of from 0.05 to 5.0 $g/m^2$.

In the intermediate layer, each of the coupling component and the color forming assistant is preferably used in a total amount of from 0.01 to 5.0 $g/m^2$.

While the present invention relates to a copying material utilizing photosensitive diazo compounds, the terminology "light-insensitivity" as used herein means that the photosensitivity of the diazo compound is not substantially utilized. Hence, the light-insensitive intermediate layer may contain a small amount of the diazo compound in some cases depending on the coating method, but such does not deviate from the present invention.

The components which are not incorporated into microcapsules, such as the diazo compound, coupling component, basic substance, and color forming assistant, are preferably dispersed as solid particles together with a water-soluble high molecular weight polymer by means of a sand mill. The water-soluble high molecular weight polymer preferably includes those used for the preparation of microcapsules. Specific examples thereof are given, e.g., in, JP-A-59-190886 (corresponding to U.S. Pat. No. 4,650,740). In this case, each of the diazo compound, coupling component, and color forming assistant is charged in the water-soluble high molecular weight polymer solution in an amount of from 5 to 40% by weight based on the water-soluble high molecular weight polymer solution and preferably dispersed to a particle size of not greater that 10 μm.

To reduce yellowing of the background after copying, the copying material of the present invention can contain a free radical generator capable of generating a free radical upon light irradiation. Suitable free radical generators include those generally employed in photopolymerizable compositions. Examples of suitable free radical generators include aromatic ketones, quinones, benzoin, benzoin ethers, azo compounds, organic disulfides, and acyloxime esters. The free radical generator is preferably added in an amount of from 0.01 to 5 parts by weight per part by weight of the diazo compound.

For the same purpose of reducing yellowing as described above, the copying material can also contain a polymerizable compound having an ethylenically unsaturated bond (hereinafter referred to as a vinyl monomer). The vinyl monomer is a compound having at least one ethylenically unsaturated bond (e.g., vinyl group or vinylidene group) per molecule and includes both monomer compounds and prepolymers thereof. Examples of the vinyl monomer include unsaturated carboxylic acids and salts thereof, esters of unsaturated carboxylic acids and aliphatic polyhydric alcohols, and amides of unsaturated carboxylic acids and aliphatic polyamine compounds. The vinyl monomer is usually used in an amount of from 0.2 to 20 parts by weight per part by weight of the diazo compound.

It is particularly preferable that the above free radical generator and/or vinyl monomer be encapsulated together with the diazo compound.

In addition to the above-described components, the copying material of the present invention may further contain acid stabilizers, e.g., citric acid, tartaric acid, oxalic acid, boric acid, phosphoric acid, and pyrophosphoric acid.

The copying material of the present invention can be produced by applying a coating composition for a intermediate layer and a coating composition for a photosensitive layer on a support, such as paper and synthetic resin films, either simultaneously or successively be various coating techniques, such as bar coating, blade coating, air knife coating, gravure coating, roll coating, spray coating, dip coating, and curtain coating, followed by drying to form an intermediate layer having a solids content of from 0.2 to 10 g/m$^2$ and a photosensitive layer having a solids content of from 2 to 20 g/m$^2$.

Suitable supports for use in this invention include any kind of ordinary paper support employed in pressure-sensitive or heat-sensitive recording materials and dry or wet development type diazo copying materials; as well as a neutral paper having a pH of from 6 to 9 and having been sized with a neutral sizing agent, e.g., alkyl ketene dimers; paper having a specific Stöckigt sizing degree/basis weight (in grams per square meter) ratio and a Beck's degree of smoothness of 90 seconds or more as disclosed in JP-A-57-116687; paper having an optical surface roughness of 8 μm or less and a thickness between 30 and 150 μm as disclosed in JP-A-58-136492; paper having a density of 0.9 g/m$^2$ or less and an optical contact ratio of 15% or more as disclosed in JP-A-58-69091 (corresponding to U.S. Pat. No. 4,484,205); paper impermeable to a coating composition which is obtained from a pulp beaten to a C.S. freeness (JIS P-8121) of 400 cc or more as disclosed in JP-A-58-69097; paper prepared by a Yankee machine, whose glossy surface is coated to provide a recording layer having improved color density and improved resolving power as disclosed in JP-A-58-65695; and paper having been subjected to a corona discharge treatment to improve coating properties as disclosed in JP-A-59-35985.

The synthetic resin film for use as a support can be selected arbitrarily from among known materials having dimensional stability against heating during development, such as polyester films (e.g., polyethylene terephthalate film, polybutylene terephthalate film, polycarbonate film), cellulose derivative films (e.g., cellulose triacetate film), polyolefin films (e.g., polystyrene film, polypropylene film, polyethylene film), and polyimide films. These synthetic resin films may be used either alone or in the form of a laminate thereof. The support usually has a thickness of from 20 to 200 μm.

In order to enhance adhesion between the paper or resin support and the coating layer, the support may be subjected to known a pretreatment, such as undercoating.

Image formation on the copying material according to the present invention is preferably performed as follows. The photosensitive layer is exposed to light in proportion to the image of an original to form a latent image while fixing the non-image area. The light source for exposure includes various types of fluorescent lamps, xenon lamps, and mercury lamps. For efficient fixing of the non-image areas, it is desirable that the emission spectrum of the light source used is consistent with the absorption spectrum of the diazo compound used in the copying material. The exposed photosensitive layer is then heated (preferably about 80° C. to about 180° C.) over the entire surface thereof to develop the latent image. Suitable heating means includes a thermal pen, a thermal head, infrared rays, a high-frequency heater, a heat block and a heat roller.

As described above, the feature of the present invention resides in that an intermediate layer containing at least one of the coupling component and the color forming assistant is provided between a photosensitive layer and a support to thereby eliminate the problem of uneven photo-fixing leading to uneven density of a reproduced image which arises from localization of the photosensitive diazo compound caused by surface unevenness of the support or penetration of the diazo compound into the support. When, the intermediate layer contains the coupling component, any amount of the diazo compound which has penetrated into the support and hence failed to contribute to the color formation system can be made use of to thereby provide a high quality reproduced image having a high color density.

The present invention is now illustrated in greater detail by way of the following Example, but it should be understood that the present invention is not deemed to be limited thereto. In the example, all the parts and percents are by weight unless otherwise indicated.

EXAMPLE

Preparation of Microcapsule Dispersion

To a mixed solvent consisting of 6 parts of tricresyl phosphate and 5 parts of ethyl acetate were added 3.45 parts of 1-morpholino-2,5-dibutoxybenzene-4-diazonium hexafluorophosphate and 18 parts of a 3:1 adduct of xylylene diisocyanate and trimethylolpropane. The resulting mixture was heated to form a solution. The resulting diazo compound solution was mixed with an aqueous solution of 5.2 parts of polyvinyl alcohol in 58 parts of water and emulsified at 20° C. to prepare an emulsion having an average particle size of 2.5 μm.

100 parts of water was added to the emulsion. The resulting mixture was then heated at 60° C. for 2 hours while stirring to prepare a capsule dispersion containing the diazo compound as a core material.

Preparation of Coupling Component-Color Forming Assistant Dispersion

Ten parts of 2-hydroxy-3-naphthoic acid anilide and 10 parts of triphenylguanidine were dispersed in 200 parts of a 5% aqueous solution of polyvinyl alcohol in a sand mill for about 24 hours to prepare a dispersion having an average particle size of 3 μm.

Preparation of Copying Materials

Sample A 50 parts of the dispersion of the coupling component and triphenylguanidine and 10 parts of a 40% calcium carbonate dispersion were added to 50 parts of the capsule dispersion to prepare a coating composition. The composition was coated on a smooth fine paper support having a basis weight of 75 g/m$^2$ by means of a coating bar to a dry weight of 10 g/m$^2$ and dried at 50° C. for 1 minute to prepare a copying material. The resulting copying material was designated as Sample A.

Sample B

Eighty parts of calcined kaolin and 160 parts of a 0.5% aqueous solution of sodium hexametaphosphate were dispersed in a homogenizer 60 parts of the above-prepared dispersion of 2-hydroxy-3-naphthoic acid anilide and triphenylguanidine in polyvinyl alcohol was then added to 30 parts of the resulting dispersion to prepare a coating composition for an intermediate layer.

The resulting coating composition was coated on the same paper support as used in Sample A to a dry weight of 6 g/m$^2$ and dried. The same coating composition as used in Sample A was coated on the thus formed intermediate layer in the same manner as for Sample A to prepare Sample B.

Sample C

A dispersion was prepared in the same manner as for Sample B, except for replacing calcined kaolin with a precipitated calcium carbonate fine powder. To the resulting dispersion was added 60 parts of a dispersion of 20 parts of 2-hydroxy-3-naphthoic acid anilide in 200 parts of polyvinyl alcohol to prepare a coating composition for an intermediate layer. Sample C was prepared in the same manner as for Sample B, except for using the thus obtained coating composition for the formation of an intermediate layer.

Evaluation

A sheet of tracing paper having a circle pattern of 3 cm in diameter evenly painted black with a 2B pencil was used as an original. Each of Samples A, B, and C was exposed to light emitted from a fluorescent lamp having an emission peak at 420 nm through the original in intimate contact therewith. The copying material was then heated with a heat block at 100° C., 120° C. or 160° C. for 3 seconds to form an image. The densities of the developed image area and the background of each sample were measured with a Macbeth densitometer, and the results obtained are shown in Table 1.

In order to evaluate shelf life of the samples, each of the samples was preserved under conditions of 40° C. and 90% room humidity (RH) for 24 hours or conditions of 60° C. and 30% RH for 24 hours and then subjected to the same test as described above (the heat developing temperature was fixed at 120° C.). The results obtained are shown in Table 2.

Further, each of unexposed Samples A, B, and C was passed through heat rollers set at 90° C. to obtain a solid image, and unevenness in density was observed with the eyes. The results obtained are shown in Table 3.

TABLE 1

| | Image Density | | | Background Density | | | |
|---|---|---|---|---|---|---|---|
| Sample | 100° C. | 120° C. | 160° C. | 100° C | 120° C. | 160° C. | Remark |
| A | 1.18 | 1.21 | 1.22 | 0.11 | 0.12 | 0.14 | Comparison |
| B | 1.28 | 1.35 | 1.36 | 0.12 | 0.12 | 0.13 | Invention |
| C | 1.23 | 1.30 | 1.31 | 0.11 | 0.11 | 0.12 | " |

TABLE 2

| | Image Density | | | Background Density | | | |
|---|---|---|---|---|---|---|---|
| Sample | Fr. | 90% RH | 30% RH | Fr. | 90% RH | 30% RH | Remark |
| A | 1.21 | 1.18 | 1.17 | 0.12 | 0.15 | 0.14 | Comparison |
| B | 1.35 | 1.33 | 1.31 | 0.12 | 0.15 | 0.14 | Invention |
| C | 1.30 | 1.27 | 1.25 | 0.11 | 0.14 | 0.15 | " |

Note.
Fr. means the value before the test.

TABLE 3

| Sample | Unevenness in Density on Solid Printing (90° C.) |
|---|---|
| A | poor evenness (high density spots were observed) |

TABLE 3-continued

| Sample | Unevenness in Density on Solid Printing (90° C.) |
|---|---|
| B | satisfactory evenness (no unevenness was observed with eyes) |
| C | satisfactory evenness (no unevenness was observed with eyes) |

As can be seen from Tables 1 to 3, the copying materials having an intermediate layer according to the present invention provide high quality images having high color densities without unevenness even when developed at low temperatures while retaining satisfactory shelf lives.

While the invention has been described in detail and with reference to specific embodiments thereof, it will be apparent to one skilled in the art that various changes and modifications can be made therein without departing from the spirit and scope thereof.

What is claimed is:

1. A heat development copying material, comprising:

a support having provided thereon a photo-sensitive layer containing a diazo compound, a coupling component, a color-forming assistant, and a film-forming high polymeric binder; and a light-insensitive intermediate layer containing a film-forming high polymeric binder, and at least one member selected from the group consisting of a coupling component and a color-forming assistant, wherein said light-insensitive intermediate layer is provided between said support and said photo-sensitive layer.

2. The heat development copying material according to claim 1, wherein at least one of said diazo compound and said coupling component contained in said photo-sensitive layer and said light-insensitive intermediate layer, is encapsulated in microcapsules, wherein said microcapsules are formed from at least one high molecular weight polymer selected from the group consisting of polyurea and polyurethane.

3. A heat development copying material according to claim 1, wherein said diazo compound is represented by formula:

$$ArN_2X$$

wherein Ar represents a substituted or unsubstituted aromatic ring; $N_2$ represents a diazonium group; and X represents an acid anion.

* * * * *